US005961874A

United States Patent [19]

Hasebe et al.

[11] Patent Number: 5,961,874

[45] Date of Patent: Oct. 5, 1999

[54] FLAT FORMED SUBMERGED ENTRY NOZZLE FOR CONTINUOUS CASTING OF STEEL

[75] Inventors: Etsuhiro Hasebe; Tetsuro Fushimi, both of Kariya; Tatsuya Shimoda, Hekinan; Yoichiro Mochizuki, Kariya; Tadasu Takigawa, Anjo; Toshihiko Murakami; Sei Hiraki, both of Kashima, all of Japan

[73] Assignees: Toshiba Ceramics Co., Ltd., Tokyo; Sumitomo Metal Industries, Ltd., Osaka, both of Japan

[21] Appl. No.: 09/045,869

[22] Filed: Mar. 23, 1998

[51] Int. Cl.[6] ..... B22D 41/50

[52] U.S. Cl. ..... 222/606; 222/594

[58] Field of Search ..... 222/606, 607, 222/591, 590, 594; 164/337, 437

[56] References Cited

U.S. PATENT DOCUMENTS

| | | | |
|---|---|---|---|
| 5,314,099 | 5/1994 | Butz et al. | 222/606 |
| 5,429,283 | 7/1995 | Luhrsen et al. | 222/606 |
| 5,603,860 | 2/1997 | Hohenbichler | 222/607 |
| 5,785,880 | 7/1998 | Heaslip et al. | 222/594 |

*Primary Examiner*—Scott Kastler
*Attorney, Agent, or Firm*—Foley & Lardner

[57] ABSTRACT

In a flat casting nozzle 10 having a taper 13, the position of the terminal end 14 of the taper 13 formed on the long edge side and the position of the terminal end 17 of a taper 16 formed on the short edge side are mutually shifted.

13 Claims, 3 Drawing Sheets

FLAT FORMED SUBMERGED ENTRY NOZZLE FOR CONTINUOUS CASTING OF STEEL

BACKGROUND OF THE INVENTION

1. Field of the Invention

This invention relates to a submerged entry nozzle (SEN) for steel and, in particular, to a casting nozzle having a flat taper.

More specifically, this invention relates to a flat continuous casting nozzle particularly preferred as a thin slab continuous casting submerged entry nozzle (SEN).

2. Description of Related Art

In casting steel, a submerged entry nozzle (SEN) is used in order to prevent oxidation of molten steel. A flat SEN having a lateral width extended toward the bottom so as to be suitable for continuous casting of a thin slab or plate has been used for a long time.

FIG. 5 shows a conventionally used flat continuous casting SEN, wherein a side view showing the long edge side is on the left, and a side view showing the short edge side on the right. In FIG. 5, a flat SEN 1 has a flange 3 on the upper part, and the flange 3 is engagingly locked to a locking fitting 4, whereby the SEN 1 is engaged with the tundish nozzle 2. The respective corresponding positions of the left side view and the right side view of FIG. 5 are mutually connected by broken lines, and tapered parts 5, 6 of the SEN are formed so that the respective terminal positions are mutually conformed on the long edge side and short edge side of the SEN as shown in the drawing.

As a result of various examinations for the generating form of thermal stress with respect to such a conventional SEN in which the terminal positions of the tapered surfaces of a flat SEN are mutually conformed, it was recognized that stress concentration exists in the taper terminal positions of the nozzle. This was confirmed also by finite-element analysis based on the physical properties shown in Table 1.

TABLE 1

| Physical Properties of Member Used for Analysis | |
|---|---|
| Bulk Density | 2.37 |
| Thermal Expansion (%) (1000° C.) | 0.29 |
| Young's Modulus (kgf/cm$^2$) | $0.09 \times 10^6$ |
| Poisson's Ratio | 0.2 |
| Thermal Conductivity (cal/cm.deg.sec) | 12.1 |

Under the boundary condition for analysis that molten steel of 1540° C. is poured into a nozzle inner hole at an outside air temperature of 30° C., the stress generated in the nozzle was calculated. The analysis was performed with a ¼ divided nozzle as a model. A constraining force of 4.4 kg/cm$^2$ was imparted to the flange on the nozzle upper end. Thus, in the stress analytic result, the stress generated in the neck part, which is based on constraining force, is excluded from the examination of the generated stress by the coincidence of the taper terminal parts.

SUMMARY OF THE INVENTION

In consideration that the concentrating position of thermal stress in the conventional flat SEN corresponds to the position where the terminal positions of the nozzle long-edge side taper and short-edge side taper are mutually conformed, an object of the invention is to provide a flat continuous casting nozzle in which the thermal stress generated in the whole nozzle is relaxed by shifting the terminal position of the long-edge side taper from the terminal position of the short-edge side taper.

The invention thus comprises a flat formed SEN for continuous casting of steel having a taper part and flattened at least in the lower end part wherein the position of the taper terminal formed on the long edge side and the taper terminal formed on the short edge side are shifted from the same horizontal plane when the casting nozzle is vertically supported (claim 1), a flat formed SEN for continuous casting of steel, according to claim 1 wherein the taper terminal position formed on the long edge side is shifted from the position of the taper terminal formed on the short edge side by at least 10 mm or more (claim 2), a flat formed SEN for continuous casting of steel, according to claim 1 or 2 wherein the taper terminal parts are shifted from the same plane in both the inner and outer surfaces of the nozzle hole (claim 3), a flat formed SEN for continuous casting of steel, according to claim 1, 2 or 3 wherein the start ends of the tapers are also shifted from the same plane (claim 4), and a flat formed SEN for continuous casting of steel according to either one of claims 1 to 4 which is for thin slab casting (claim 5).

DETAILED DESCRIPTION OF PREFERRED EMBODIMENTS

Figure 1A:
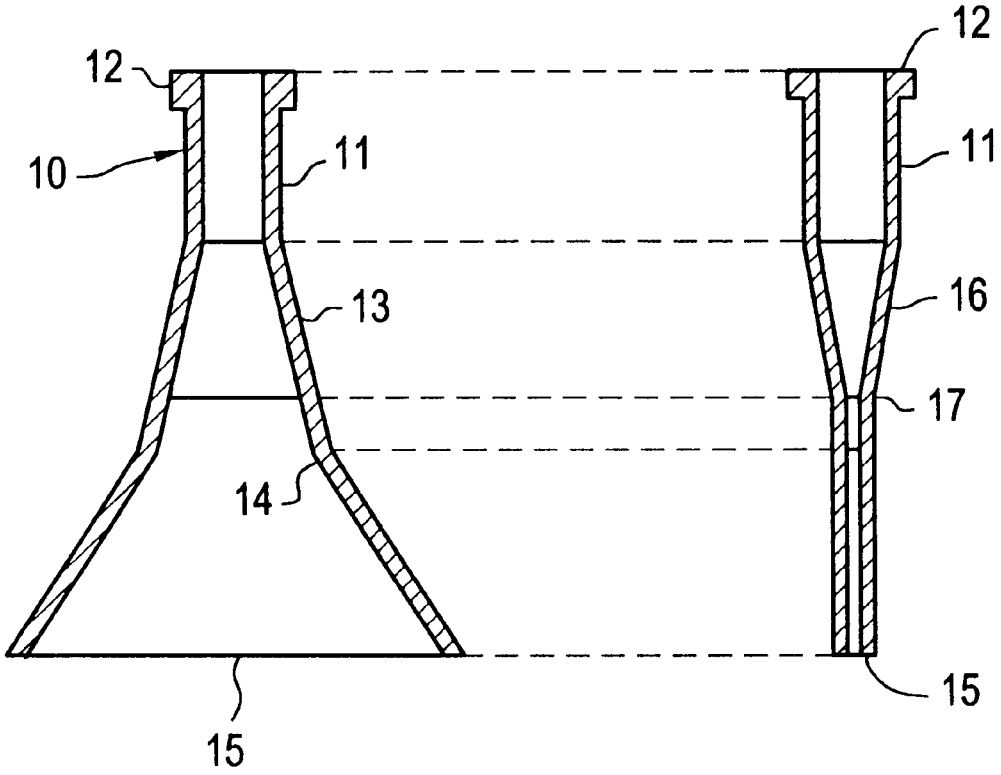
FIGS. 1*a* and 1*b* are views showing a thin slab casting according to one preferred embodiment of this invention in which corresponding parts of the long-edge side view and the short-edge side view are mutually connected by broken lines, respectively.

FIG. 1 shows the long edge side and short edge side of a flat continuous casting SEN according to one preferred embodiment of this invention. In FIG. 1*a,* the long edge side of the nozzle is shown on the left, and the short edge side on the right, wherein the respective corresponding positions are mutually connected by broken lines.

In FIG. 1*a,* a flat continuous casting nozzle 10 having a cylindrical upper part 11 and a flange 12 on the top end is shown. In the long edge side shown on the left of FIG. 1*a,* the lower side of the cylindrical part of the nozzle upper part 11 is laterally extended at a gentle angle to form a taper 13. The terminal part 14 of the taper 13 is extended further more laterally. A nozzle bottom part 15 has a rectangular section. The short edge side which is the side surface of the nozzle is shown on the right of FIG. 1*a.* The upper part 11 and the flange 12 of the nozzle are the same as described above on the long edge side as shown in the drawing, but the terminal part 17 of a taper 16 is situated in a position shifted upward from the long-edge side terminal part 14. In the taper 16, the width is gradually narrowed so that the nozzle is flattened. The taper 16 is extended from the terminal part 17 to the nozzle bottom part 15 with a fixed width.

Figure 1B:
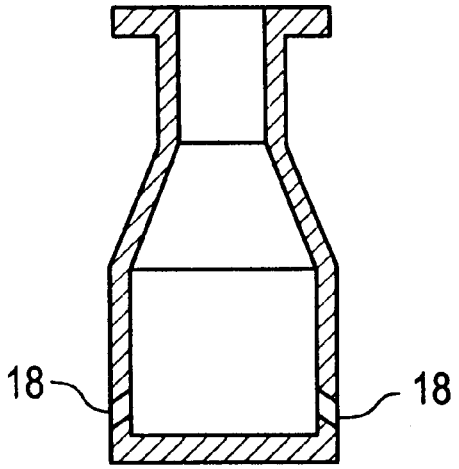

Including a continuous casting SEN having discharge ports 18 for molten steel on both sides of the short edge side as shown in FIG. 1*b,* the nozzle is tapered in the same manner as in FIG. 1*a.*

Figure 2:
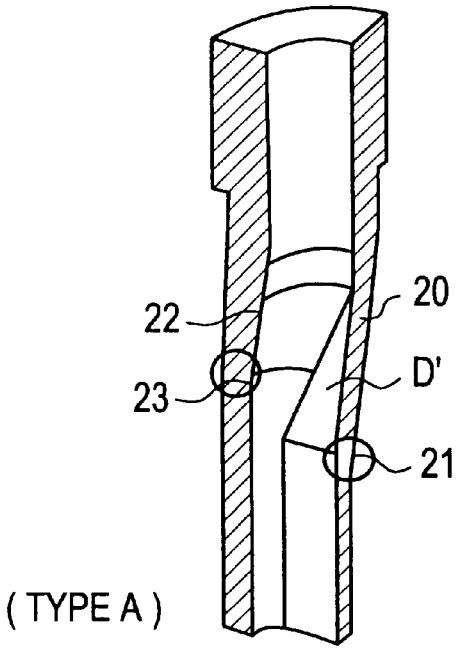
FIG. 2 is a partially vertical section of the flat continuous casting nozzle in which the stress concentrating position thereof is shown.
Figure 3:
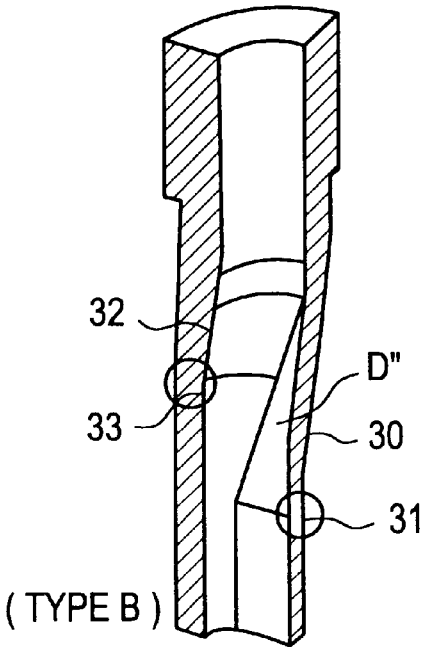
FIG. 3 is a partially vertical section of a flat continuous casting nozzle according to another embodiment of this invention in which the stress concentrating position thereof is shown.

The nozzles of this invention were analyzed by finite element method, and the stress concentrating positions of the nozzles were examined on the basis of this. The results are shown in FIG. 2 and FIG. 3 showing partially vertical sections of the nozzles. The result for a conventional nozzle is also shown in FIG. 4 in the same manner.

In the nozzle shown in FIG. 2, the terminal part 21 of a taper 20 formed on the long edge side of the nozzle is shifted down by 50 mm from a terminal part 23 of a taper part 22 formed on the short edge side. Therefore, the encircled stress concentrating positions are vertically shifted and dispersed to the two positions in the nozzle shown in FIG. 2. Consequently, the stress generated in the respective positions are minimized, so that the damage of the nozzle can be remarkably reduced.

FIG. 3 shows a part of a nozzle of this invention, which is basically the same as that shown in FIG. 2, wherein the terminal part 31 of a taper 30 formed on the long edge side of the nozzle is shifted down by 100 mm from the terminal part 33 of a taper 32 formed on the short edge side thereof.

Figure 4:
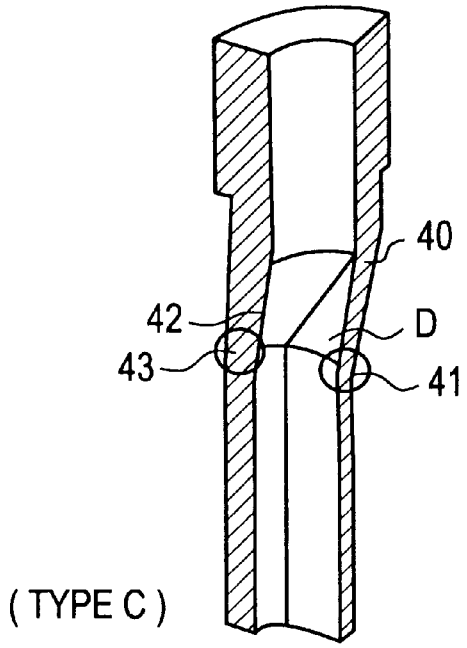
FIG.4 PRIOR ART
FIG. 4 is a partially vertical sectional view of a conventional flat continuous casting nozzle in which the stress collecting position is shown.
Figure 5:
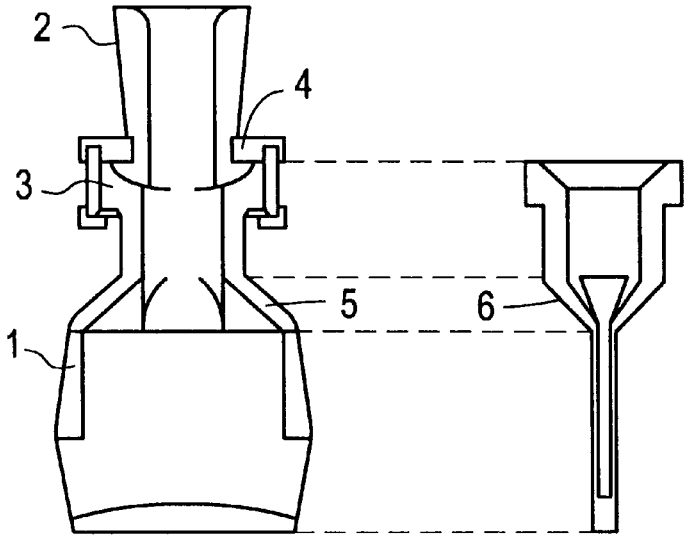
FIG.5 PRIOR ART
FIG. 5 is a view showing the conventional flat casting nozzle in which corresponding parts of the long-edge side view and the short-edge side view are mutually connected by broken lines, respectively.

FIG. 4 shows a conventional nozzle in the same manner as the above. Namely, the position of the terminal part 41 of a taper part 40 formed on the long edge side of the nozzle coincides with the position of the terminal part 43 of a taper 42 formed on the short edge side in the horizontal direction. Since the encircled stress concentrating positions horizontally coincide between the terminal part of the long-edge side taper and the terminal part of the short-edge side taper, in this case, the stress concentration in this part is increased.

Table 2 shows the stresses generated in the short-edge side terminal parts 43, 23, 33 and delta parts D, D', D" of a conventional nozzle (Type C) and nozzles (Types A, B) shown in FIGS. 2 and 3 employed in the analysis described above.

TABLE 2

Maximum Tensile Stress Generated in Nozzle

| Type | A | B | (MPa) C |
|---|---|---|---|
| Short edge side taper terminal part | 11.07 | 10.30 | 12.06 |
| Delta part | 10.66 | 9.89 | 9.18 |

Nozzles having the long edges and short edges shown in FIG. 2 or FIG. 3, which have characteristics as shown in Table 3, were manufactured with alumina-graphite material. Low carbon aluminum killed steel was casted at 1545° C. for 60 minutes with these nozzles. The nozzles were then examined to determine whether the short-edge side taper terminal part of each nozzle was cracked. As a result, although the nozzles of type A and type B shown in FIG. 2 and FIG. 3 were not cracked, the nozzle of type C (conventional type) shown in FIG. 4 was cracked in the short-edge side taper terminal position.

TABLE 3

Material Characteristics of Specimen Nozzle

| | | $Al_2O_3$-Graphite Material |
|---|---|---|
| Chemical Component (%) | $Al_2O_3$ | 48 |
| | C + SiC | 30 |
| | $SiO_2$ | 20 |
| Physical Characteristics | Bulk Density | 2.37 |
| | Modulous of Rupture | 8.5 |
| | Young's Modulus (GPa) | 9.0 |
| | Thermal Expansion (% at 1000° C.) | 0.29 |

According to this invention, the positions of the long edge-side taper terminal part and short edge-side taper terminal part of a flat continuous casting nozzle are not mutually conformed but shifted, whereby the thermal stress apt to be collectively generated in the taper terminal parts of the flat nozzle can be relaxed to improve the spalling resistance of the nozzle. Although the spalling resistance of the nozzle can be, of course, improved by the selection of material, the spalling resistance can be also structurally improved according to this invention, in addition to the selection of material.

In thin slab casting devices, particularly, it is difficult to impart a sufficient strength to the SEN because the internal space of a mold to which the nozzle is installed for casting is narrow, and the mold short-edge side allowable thickness of the nozzle to be inserted is significantly controlled.

This invention thus aims at finding and providing a form and structure sufficiently resistant to a thermal shock or thermal stress by molten steel flow under such a condition.

This invention is attained by improving the form of a nozzle developed mainly for thin slab casting device, since the nozzle is frequently cracked when flatted for thin slab. In this invention, raw materials of various compositions practically applicable to casting refractory materials can be used without being limited to the material described in the above embodiments, and the flange may be extended so as to act as a slide gate plate. The nozzles of this invention may be integrally molded or formed by adhering or bonding a plurality of members. Further, the angle part formed as the taper terminal part or start end part may be rounded.

While this invention has been described with reference to embodiments having two-stage taper parts, it can be, needless to say, applied to taper parts having three stages or more without being limited to this number of stages. In case of three stages, for example, "taper terminal part" is replaced by "one or more terminal parts of each taper part" in execution of this invention, whereby the application is facilitated.

What is claimed is:

1. A flat-formed submerged entry nozzle for a continuous casting of steel, comprising:

an upper part;

a taper part extending below the upper end part, the taper part having a long edge side and a short edge side, the long edge side having a first taper and the short edge side having a second taper; and a terminal part extending below the taper part, the terminal part having a flattened nozzle configuration, wherein each of the first and second taper has a respective lower terminal edge line, and wherein the lower terminal edge line of the first taper is vertically displaced from the lower terminal edge line of the second taper.

2. A flat formed submerged entry nozzle for continuous casting of steel according to claim 1, wherein a distance between the lower terminal edge lines of the first and second tapers is at least 10 mm.

3. A flat formed submerged entry nozzle for continuous casting of steel according to claim 1, wherein the lower terminal edge lines of the first and second tapers are shifted from the same plane in both an inner and an outer surface of the nozzle hole.

4. A flat formed submerged entry nozzle for continuous casting of steel according to claim 1, wherein each of the first and second tapers has an upper terminal edge line and wherein the upper terminal edge lines of the first and second tapers are vertically shifted from each other.

5. A flat formed submerged entry nozzle for continuous casting of steel according to claim 1, wherein each of the lower terminal edge lines of the first and second tapers lies in a different plane.

6. A flat-formed submerged entry nozzle for a continuous casting of steel, comprising:

a cylindrical upper part;

a taper part extending below the upper end part, the taper part having a long edge side and a short edge side, the long edge side having a first taper and the short edge side having a second taper; and a terminal part having a rectangular cross-section extending below the taper part, wherein each of the first and second taper has a respective lower horizontal terminal edge line, and wherein the lower horizontal terminal edge line of the first taper is vertically displaced from the lower horizontal terminal edge line of the second taper.

7. A flat continuous casting submerged entry nozzle according to claim 6, wherein the first horizontal terminal edge line is lower vertically than the second horizontal terminal edge line.

8. A flat continuous casting submerged entry nozzle according to claim 6, wherein the distance is at least 10 mm.

9. A flat continuous casting submerged entry nozzle according to claim 6, wherein a width of the terminal part is fixed.

10. A flat continuous casting submerged entry nozzle according to claim 6, wherein the nozzle is a monolithic unit.

11. A flat continues casting submerged entry nozzle according to claim 6, further comprising at least one discharge port on a side of the nozzle.

12. A flat continuous casting submerged entry nozzle according to claim 6, wherein the distance is at least 50 mm.

13. A flat continuous casting submerged entry nozzle according to claim 6, wherein the distance is at least 100 mm.

* * * * *